US009010816B1

(12) United States Patent
Shaffer

(10) Patent No.: US 9,010,816 B1
(45) Date of Patent: Apr. 21, 2015

(54) SAFETY GATE LATCH

(76) Inventor: Scott Shaffer, Titusville, FL (US)

( * ) Notice: Subject to any disclaimer, the term of this patent is extended or adjusted under 35 U.S.C. 154(b) by 218 days.

(21) Appl. No.: 13/456,665

(22) Filed: Apr. 26, 2012

(51) Int. Cl.
*E05C 19/00* (2006.01)
*E05C 3/12* (2006.01)
*E05C 3/02* (2006.01)

(52) U.S. Cl.
CPC ..... *E05C 3/122* (2013.01); *E05C 19/007* (2013.01); *Y10S 292/56* (2013.01); *Y10S 292/73* (2013.01)

(58) Field of Classification Search
CPC ..... E05B 17/0045; E05B 67/21
USPC ..... 292/57–59, 63, 64, 67, 68, 213, 218, 292/252, DIG. 15, DIG. 56, DIG. 73
See application file for complete search history.

(56) References Cited

U.S. PATENT DOCUMENTS

| | | | | | |
|---|---|---|---|---|---|
| 497,395 | A * | 5/1893 | Whittier | 292/194 |
| 1,193,386 | A * | 8/1916 | Hill | 292/77 |
| 1,280,665 | A * | 10/1918 | Clay | 292/216 |
| 1,664,174 | A * | 3/1928 | Hoopes, Jr. | 292/344 |
| 1,841,890 | A * | 1/1932 | Hannon | 292/204 |
| 2,277,168 | A * | 3/1942 | Strom | 292/342 |
| 2,666,660 | A | 10/1950 | Youngworth | |
| 2,687,548 | A * | 8/1954 | Price | 16/86 A |
| 3,141,188 | A * | 7/1964 | Gray | 16/86 A |
| 4,111,475 | A * | 9/1978 | McCormick et al. | 292/216 |
| 4,193,232 | A * | 3/1980 | Almsted et al. | 52/98 |
| 4,233,780 | A * | 11/1980 | Royce et al. | 49/475.1 |
| 4,595,230 | A * | 6/1986 | Fettes | 296/102 |
| 4,691,541 | A | 9/1987 | McQuade | |
| 4,784,386 | A * | 11/1988 | Muehl | 482/122 |
| 4,919,463 | A * | 4/1990 | McQuade | 292/120 |
| 5,016,928 | A * | 5/1991 | Segovia | 292/213 |
| 5,501,494 | A * | 3/1996 | Willetts | 292/262 |
| 5,593,141 | A | 1/1997 | Cain | |
| 5,794,871 | A * | 8/1998 | Willetts | 292/288 |
| 5,882,667 | A * | 3/1999 | Jones | 424/405 |
| 7,360,804 | B1 * | 4/2008 | Fidali et al. | 292/262 |
| 7,661,734 | B2 * | 2/2010 | Lignell | 292/348 |
| 7,743,780 | B1 * | 6/2010 | Eggan | 135/67 |
| 7,882,848 | B2 * | 2/2011 | Diamond | 135/77 |
| 7,905,525 | B2 * | 3/2011 | Badia | 292/262 |
| 8,230,552 | B2 * | 7/2012 | Klugh et al. | 16/42 R |
| 2005/0034270 | A1 * | 2/2005 | Newman et al. | 16/110.1 |
| 2006/0006678 | A1 * | 1/2006 | Herron, Jr. | 292/336.3 |
| 2007/0102080 | A1 * | 5/2007 | Spangler | 150/154 |
| 2011/0084185 | A1 * | 4/2011 | Frankel | 248/188.9 |
| 2012/0060877 | A1 * | 3/2012 | Kirby | 135/66 |

* cited by examiner

*Primary Examiner* — Carlos Lugo
(74) *Attorney, Agent, or Firm* — Brian S. Steinberger; Law Offices of Brian S. Steinberger, P.A.

(57) ABSTRACT

Bonded or slide on sleeve and cover devices, and replacement gate latches and methods for preventing injury with oar, fork and U-shaped gate latches that are pivotally attached to fixed support post next to an opening in a fence. The sleeves and covers and replacement oar, fork and U-shaped gate latches have enlarged blunt tips that can include bulbous, dome and ball shapes that prevent injury from children or adults that come into contact with the gate latches.

11 Claims, 9 Drawing Sheets

FIG. 7
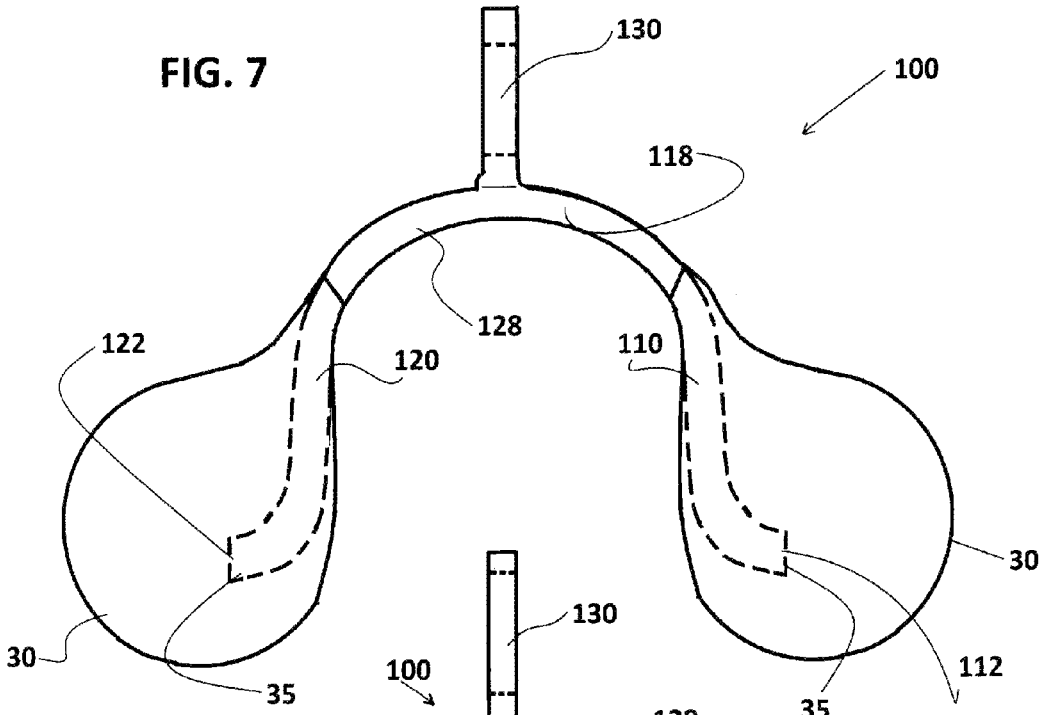
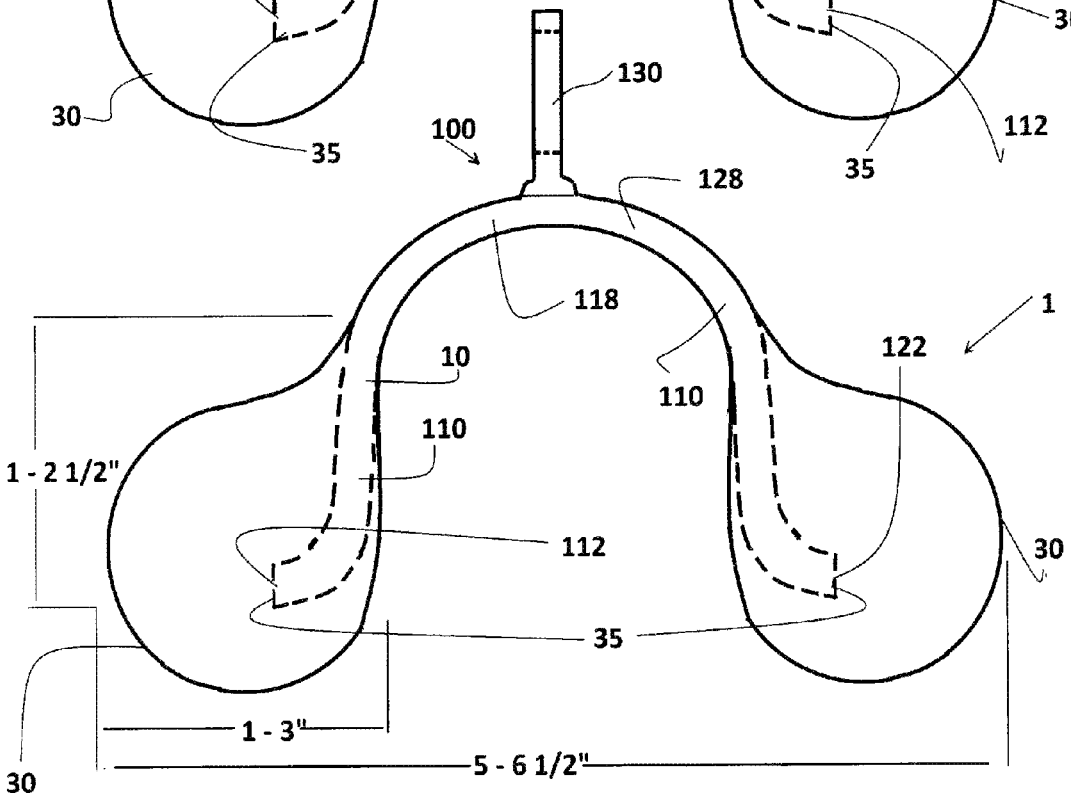
FIG. 8

FIG. 14
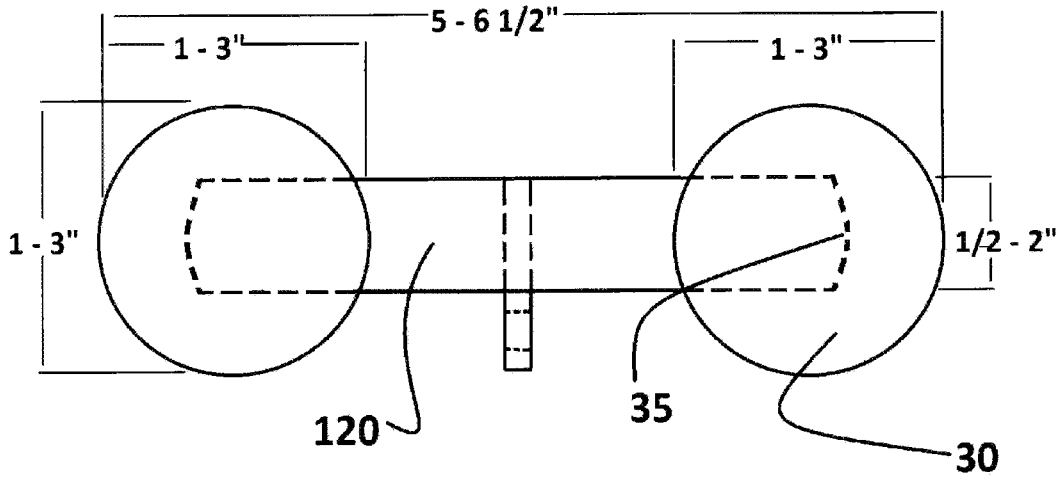
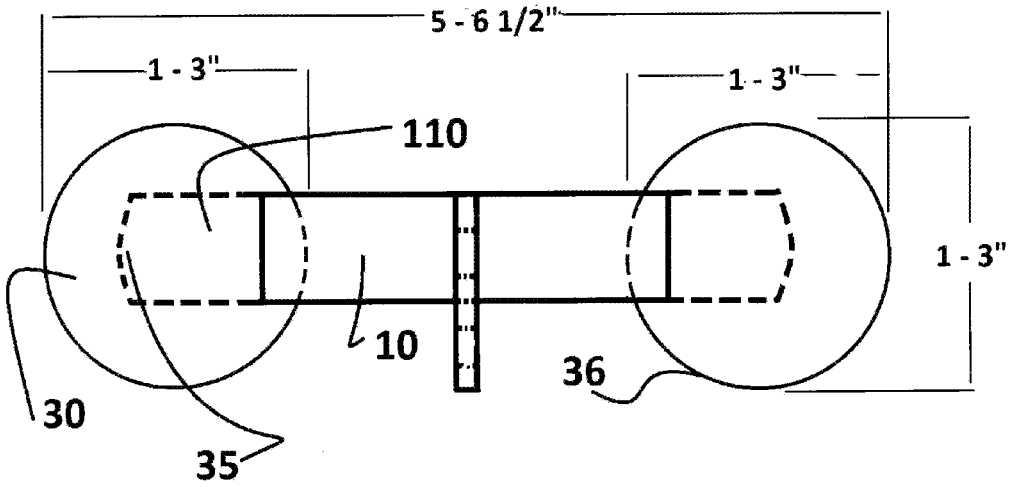
FIG. 15

SAFETY GATE LATCH

FIELD OF INVENTION

This invention relates to oar, fork and U-shaped gate latches, and in particular to bonded and slide on sleeve and cover devices, and replacement gate latches and methods for preventing injury with persons that come into contact with oar, fork and U-shape gate latches that are pivotally attached to fixed support posts next to an opening in a fence.

BACKGROUND AND PRIOR ART

Popular gate latches for mesh fences will often use a pivotable oar, fork or U-shaped latches to lock and unlock a swinging gate which is used to open and close an opening in a mesh fence. One side of the gate is usually hingedly attached to a fixed support post. The free swinging edge post of the gate will swing into and out of the pivotable gate latch. See for example, U.S. Pat. Nos. 2,666,660 to Yougworth; 4,691,541 to McQuade Sr.; and 5,593,141 to Cain et al. A problem with these popular gate latches are their narrow and often sharp metal tips which become protruding hazards when the gates are left open.

When the gate is open, the metal tips of the oar, fork or U-shape latch is generally facing sideways in a horizontal direction where the prong arms of the latch are parallel to the ground. Even if the outer tips are rounded, in these horizontal positions, injury can easily occur to someone walking into the gate latch. The problem is further compounded on playgrounds and school yards where running children can go front first and/or back first into these protruding hazards causing skin lacerations and punctures. Small children also have the danger of these protruding hazards being at face and eye level that can further cause serious harm.

Various attempts have been tried over the years to fix the problem. For example, wrapping electrical type tape around the latches is only a temporary fix, since the tape would unwrap over time, and the tape would be an attractive nuisance for children who would want to pull the tape loose. Sticking an old tennis ball on the latch is also only a temporary fix, since the ball would easily fall off or be easily pulled off.

The inventor is not aware of any products and solutions to protect children and/or adults from being injured by the protruding hazards of these oar, fork and U-shape gate latches that are left in their horizontal and unlocked positions. Thus, the need exists for solutions to the above problems with the prior art.

SUMMARY OF THE INVENTION

A primary objective of the present invention is to provide bonded on sleeve and cover devices, and methods for preventing injury from using oar, fork and U-shape gate latches that are pivotally attached to fixed support post next to an opening in a fence.

A secondary objective of the present invention is to provide slide on sleeve and cover devices, and methods for preventing injury from using oar, fork and U-shape gate latches that are pivotally attached to fixed support post next to an opening in a fence.

A third objective of the present invention is to provide replacement gate latches and methods for preventing injury from using oar, fork and U-shape gate latches that are pivotally attached to fixed support post next to an opening in a fence.

An embodiment of a the sleeve covers for a pivotable oar, fork and U shaped gate latch, can include a first sleeve having a closed end and an open end, the closed end having a rounded blunt exterior surface and a diameter substantially larger in diameter than a diameter of the open end of the sleeve, and a second sleeve having a closed end and an open end, the closed end having a rounded blunt exterior surface and a diameter substantially larger in diameter than a diameter of the open end of the sleeve, wherein the first sleeve and the second sleeve are adapted to slide on and cover the exposed existing tip ends of existing arms on a pivotable gate latch.

The closed end of each of the first sleeve and the second sleeve can each include generally bulbous shape.

The closed end of each of the first sleeve and the second sleeve can each include a generally ball shape.

The closed end of each of the first sleeve and the second sleeve can each include a generally dome shape.

The diameter of the closed end can be at least twice the diameter of the exposed tip ends of the arms on the oar, fork and U shaped gate latch.

The first sleeve and the second sleeve can attach to the gate latch by sliding over the existing arms of the oar, fork and U shaped gate latch.

The first sleeve and the second sleeve can attach to the gate latch by being bonded to the existing arms of the oar, fork and U shaped gate latch.

The first and the second sleeve covers can be formed from a rubber material.

The first and the second sleeve covers can be formed from a plastic material.

A replacement pivotable oar, fork and U shaped gate latch can include a first curved arm with an exposed outer end and a rear end, the outer end having a diameter substantially larger than a diameter of the rear end, the outer end having a rounded edge, a second curved arm with an exposed outer end and a rear end, the outer end having a diameter substantially larger than a diameter of the rear end, the outer end having a rounded edge, and a pivotable mid portion attached to the rear end of the first curved arm and the rear end of the second curved arm for allowing the first arm and second arm to pivot together in a U-shaped configuration about a gate edge.

The exposed outer end of the first arm and the second arm each can include a generally bulbous shape.

The exposed outer end of the first arm and the second arm can each include a generally ball shape.

The exposed outer end of the first arm and the second arm can each include a generally dome shape.

The diameter of the exposed outer end of the first arm and the second arm can be at least twice the diameter as the rear end of the first arm and the second arm.

Another embodiment can use ball covers for protecting exposed parts of a pivotable oar, fork and U shaped gate latch that includes a first ball with a rubber spherical outer core, the first ball having a slit opening along one side portion, a second ball with a rubber spherical outer core, the second ball having a slit opening along one side portion, and a caulking material to be injected into each of the first ball and the second ball, wherein the slits of the first and second balls are adapted to slide over exposed tip ends of existing arms on a pivotable gate latch so that the balls provide protection to the exposed tip ends of the existing arms on the pivotable gate latch.

The balls used can be tennis balls, and the caulking material can be silicon.

The arms of the replacement latch can be formed from metal. The arms can be formed from nonmetal materials or combinations of metal and nonmetal. The arms can be formed from rubber. The arms can be formed from plastic.

Further objects and advantages of this invention will be apparent from the following detailed description of the presently preferred embodiments which are illustrated schematically in the accompanying drawings.

BRIEF DESCRIPTION OF THE FIGURES

FIG. 7 is a top view of the sleeve covers attached to the gate latch of FIG. 5.

FIG. 8 is a bottom view of the sleeve covers attached to the gate latch of FIG. 5.

FIG. 14 is a right end view of the embodiment of FIG. 13.

FIG. 15 is a left end view of the embodiment of FIG. 13.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Figure 1:
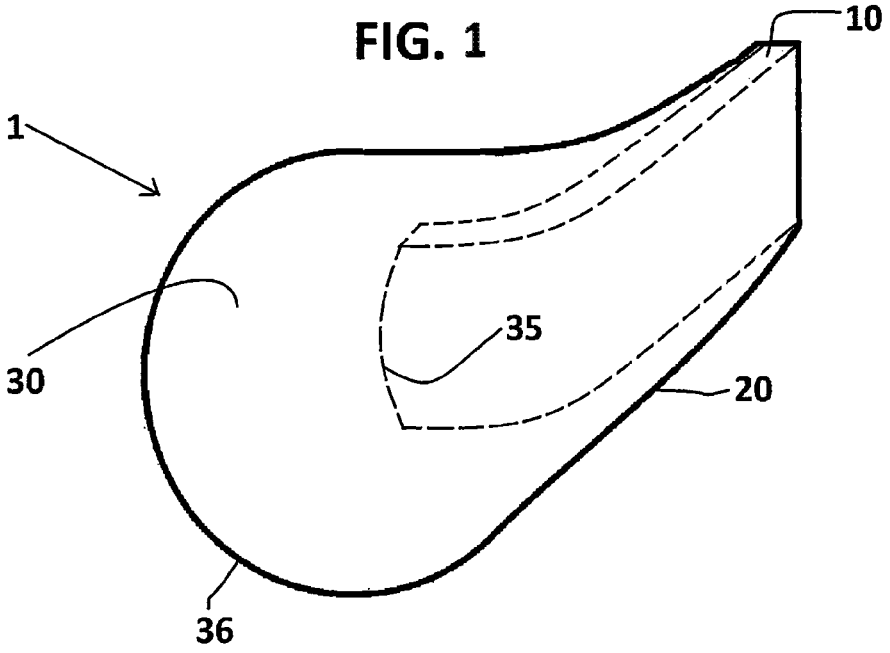
FIG. 1 is a front right perspective view of the sleeve cover invention.
Figure 2:
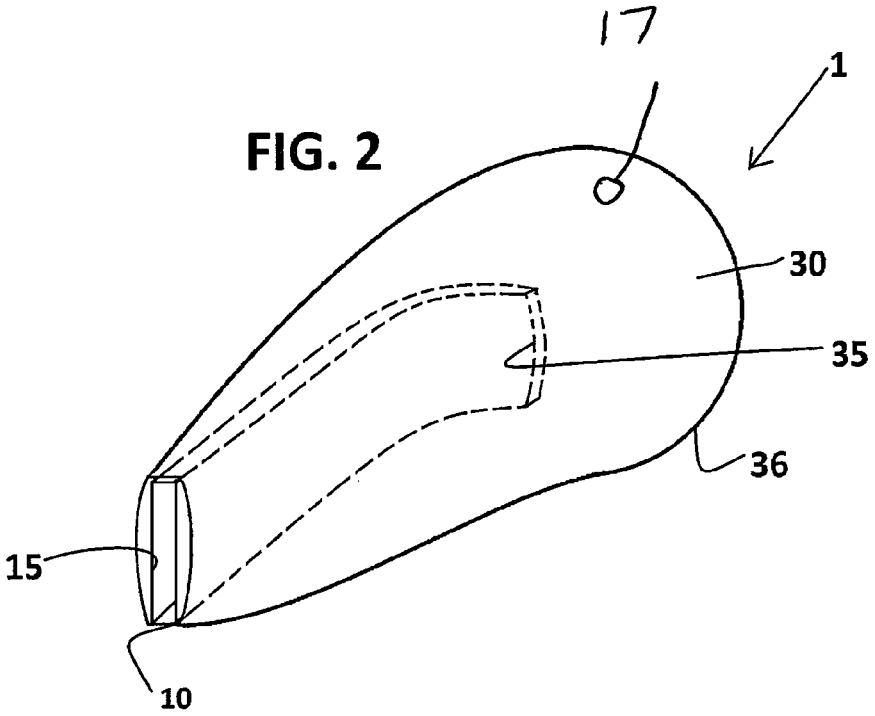
FIG. 2 is a rear right perspective view of the sleeve cover of FIG. 1.
Figure 3:
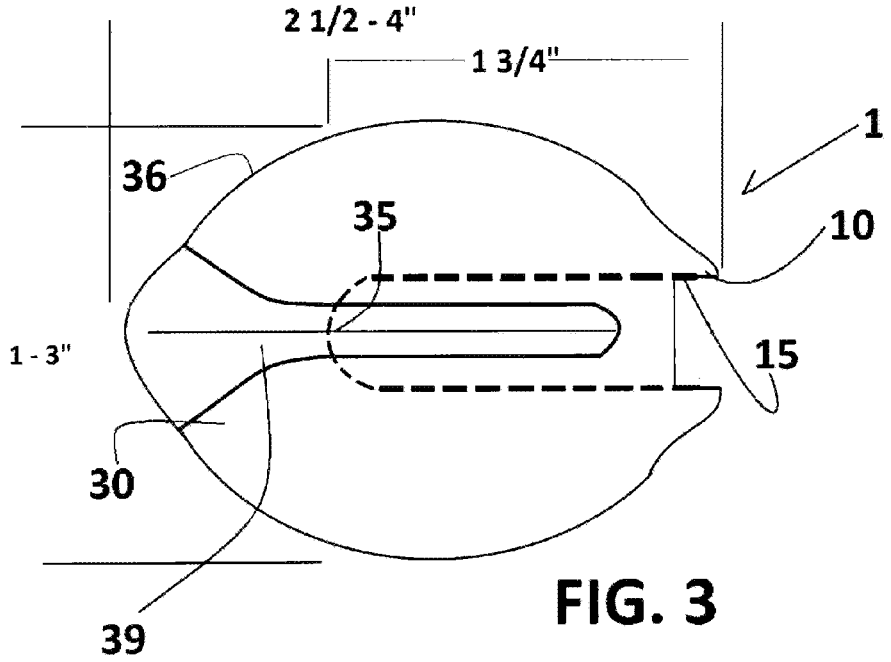
FIG. 3 is right side view of the cover of FIG. 1.
Figure 4:
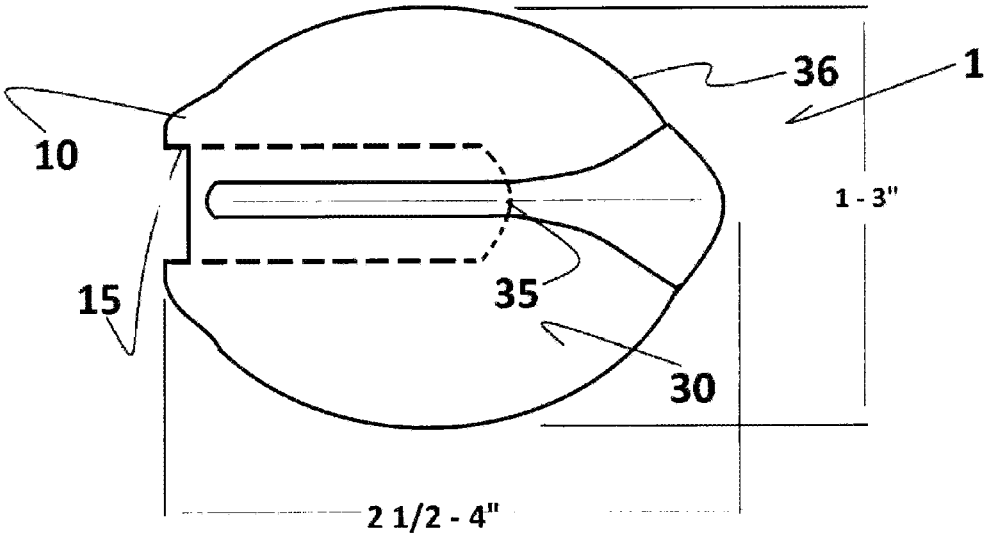
FIG. 4 is a left side view of the cover of FIG. 1.

1. sleeve cover for oar, fork or U-shape gate latch
10. root end
15. opening in root end for flange arm of gate latch
17. fill port
20. mid body
30. head end
35. stop inside of head for tip of flange arm of gate latch
36. rounded dome, bulbous or spherical exterior surface
39. side support brace with angled tip
100. existing oar, fork or U-shape gate latch
110. left curved flange arm
112. tip end of left flange arm
118. bracket end of left flange arm
120. right curved flange arm
122. tip end of right flange arm
128. bracket end of right flange arm
130. bracket for pivotally attaching gate latch to fence post
200. replacement oar, fork or U-shape gate latch
300. ball
350. slit
375. fill port FIG. 1 is a front right perspective view of the sleeve cover invention 1. FIG. 2 is a rear right perspective view of the sleeve cover 1 of FIG. 1. FIG. 3 is right side view of the cover 1 of FIG. 1. FIG. 4 is a left side view of the cover 1 of *Fig*. 1.

Referring to FIGS. 1-4, the sleeve cover 1 can be used as a protective cover for the exposed arms of an oar, fork or U-shape gate latch which are referenced in the background of this invention. The sleeve cover can include a root end 10 having an opening therein. Although the opening is shown as rectangular, the shape of the opening can be configured to the exterior geometry of the existing flange arms of an oar, fork or U-shape gate latch. The cover 1 can have a generally elongated shape with a mid body portion 20 and head portion 30. The head portion 30 can have bulbous, or ball or dome shaped configuration with an outer rounded surface 36. Inside the head portion can be an end or stop 35 against which the tip end of the flange arms) of the oar, fork or U-shape gate latch rests. The cover 1 is shown having the head 30 bent to one side to follow the contours of the underlying flange arms of the oar, fork or U-shape gate latch. If the flange arms are straight the head portion 30 may not need to be bent to one side.

Referring to FIGS. 3-4, an optional side support brace with angled tip 39 can be used to add additional rigidity to the cover 1.

A preferred embodiment of the cover 1 can have dimensions of approximately 1½ inches to approximately 4 inches long between the root end 10 and outer surface edge of the head 30. The diameter of the opening 15 can be between approximately ½ inch to approximately 1½ inches in diameter that would depend on the width of the arm flanges of the existing oar, fork or U-shape gate latch. The head 30 can have a diameter of greater than approximately 1½ inches to approximately 3 inches.

Figure 5:
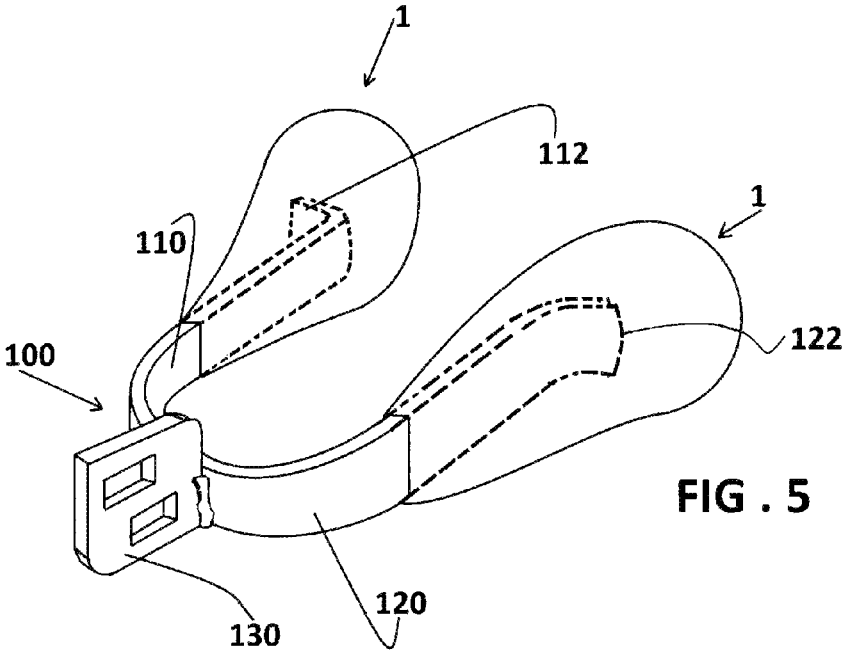
FIG. 5 is a rear top perspective view of the sleeve covers of FIG. 1 attached to an oar, fork or U-shape gate latch.
Figure 6:
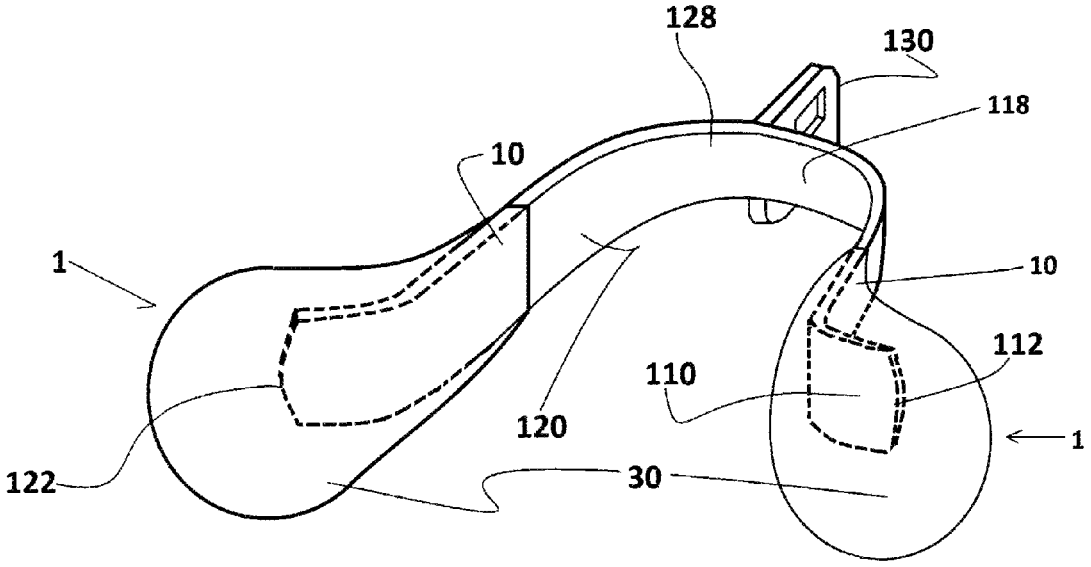
FIG. 6 is a front top perspective view of the sleeve covers attached to the oar, fork or U-shape gate latch of FIG. 5.

FIG. 5 is a rear top perspective view of the sleeve covers 1 of FIG. 1 attached to an oar, fork or U-shape gate latch 100. FIG. 6 is a front top perspective view of the sleeve covers 1 attached to the oar, fork or U-shape gate latch 100 of FIG. 5. FIG. 7 is a top view of the sleeve covers 1 attached to the gate latch 100 of FIG. 5. FIG. 8 is a bottom view of the sleeve covers 1 attached to the gate latch 100 of FIG. 5.

Referring to FIGS. 1-8, each of the sleeve covers 1 can be either slid over or bonded to the flange arms 110, 120 of the oar, fork or U-shape bracket 100. The flange arms 110, 120 with tip end 112, 122, rear end 118, 128 and bracket 130 can be an existing oar, fork or U-shape bracket, such as those shown and described in the background of the invention. Such types of oar, fork or U-shape bracket 100 include but are not limited to U.S. Pat. Nos. 2,666,660 to Yougworth; 4,691,541 to McQuade Sr.; and 5,593,141 to Cain et al., which are each incorporated by reference. The tip end 112 of one flange arm 110 can rest against an interior stop or end 35 inside the head 30 of the cover 1. The tip end 122 of another flange arm 120 can rest against an interior stop or end 35 inside the head 30 of another cover 1.

A preferred material for the sleeves 1 can include waterproof and UV stable materials, such as but not limited to rubber, polyurethane, plastic material, elastomers, silicon, other types of synthetic polymers, combinations thereof, and the like. The covers 1 can be solid poured around existing flange arms 110, 120 of an oar, fork or U-shape bracket 100. Grooves, and/or openings, and the like, can be drilled in the existing flange arms of the gate latch prior to casting to better enhance the bond between the covers 1 and the arms 110, 120 of the existing gate latch 100. Additional materials, such as bonding agents, and the like, can also be used.

The exteriors of the sleeves can have a soft exterior layer, such as but not limited to depressible silicon, over another underlying material layer, such as but not limited to a rigid rubber or rigid plastic. The soft exterior can be desirable to absorb impact and reduce injury from someone hitting or rubbing against the sleeve covered gate latches.

The covers 1 can also be preformed or pre-molded from similar waterproof and UV stable materials, as slide on sleeves, so that existing gate latches can be retrofitted separately by installers when needed. Pre-molded slide on sleeve covers 1 can be easily used in the field to wrap about the exposed ends of existing flange arms on oar, fork or U-shape gate latches. The slide on covers can tightly fit about the existing flange arms. Additionally, adhering agents, such as but not limited to glue and the like, can also be used to lock the covers 1 to the flange arms of the oar, fork or U-shape gate latch by being injected into a small opening port 17 similar to port 375 shown and described in relation to FIGS. 12-13. Additionally, a set screw or through-pin can be used to attach the sleeves to the latches. Still furthermore, heat such as that from the sun, or from an artificial heat source can also shrink wrap the sleeves to the latches.

Figure 9:
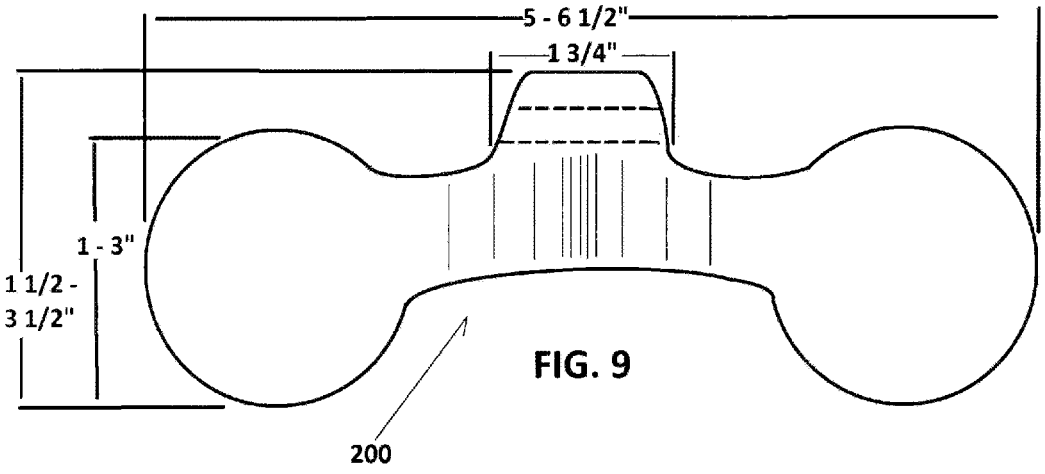
FIG. 9 is a rear view of a replacement oar, fork or U-shape gate latch.
Figure 10:
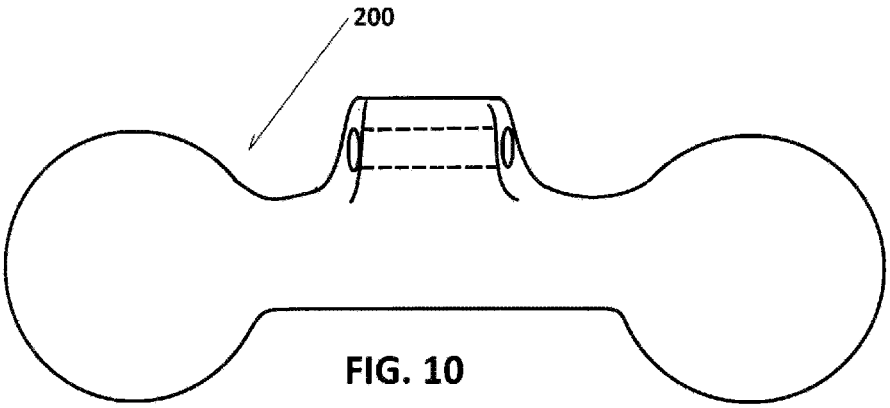
FIG. 10 is a front view of a replacement oar, fork or U-shape gate latch.
Figure 11:
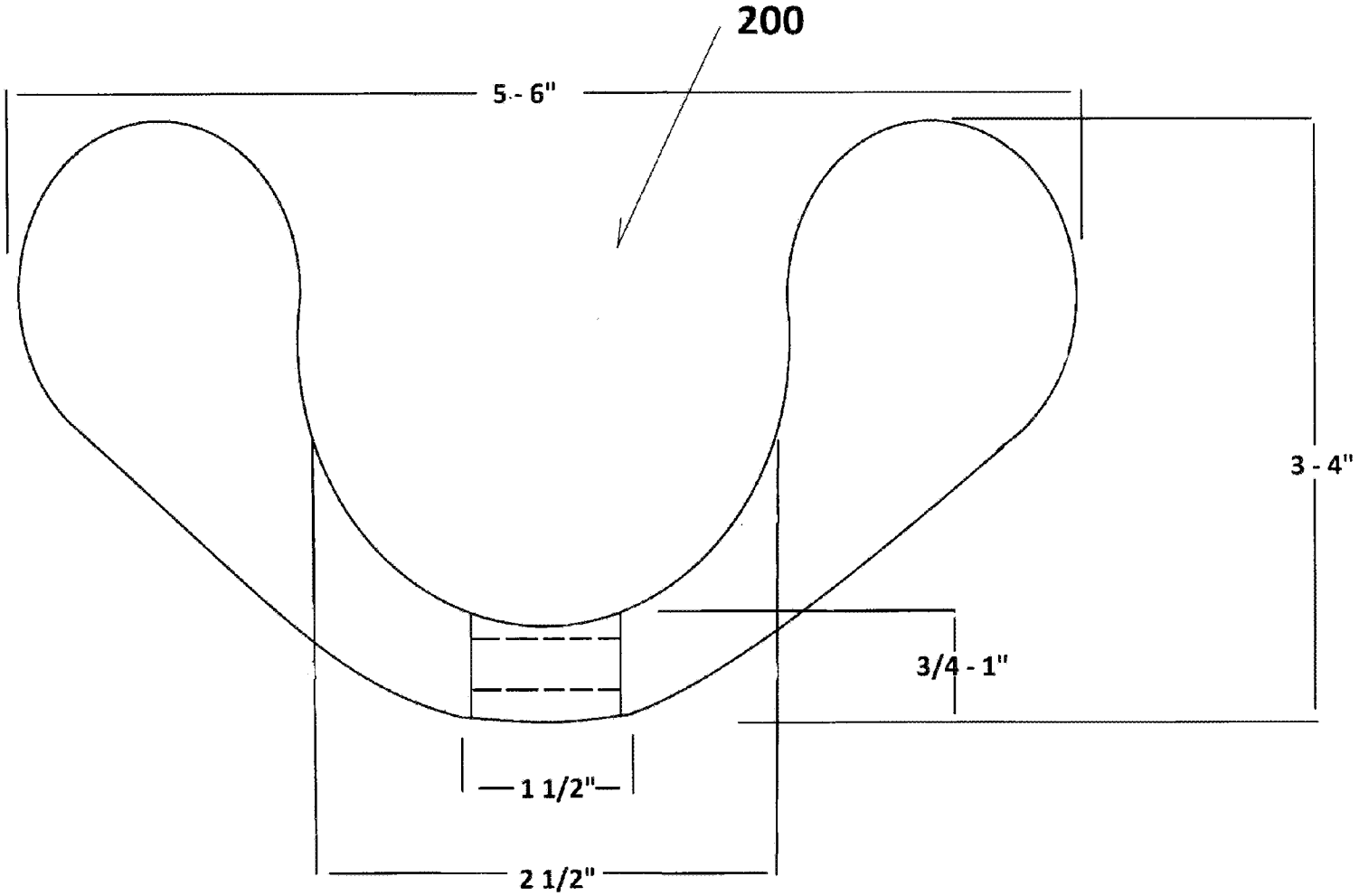
FIG. 11 is a top view of the replacement oar, fork or U-shape gate latch.

FIG. 9 is a rear view of a replacement oar, fork or U-shape gate latch 200. FIG. 10 is a front view of a replacement oar, fork or U-shape gate latch 200. In this embodiment, the entire gate latch including arms with covers and bracket can be pre-molded from non-metal flexible and semi-rigid materials, similar to the cover 1 materials. The replacement covers 200 can replace existing oar, fork or U-shape gate latches. FIG. 11 is a top view of the replacement gate latch 200 of FIGS. 9-10, and can be attached in a similar manner to the existing gate latches described in the background section of the invention.

Figures 12, 13:
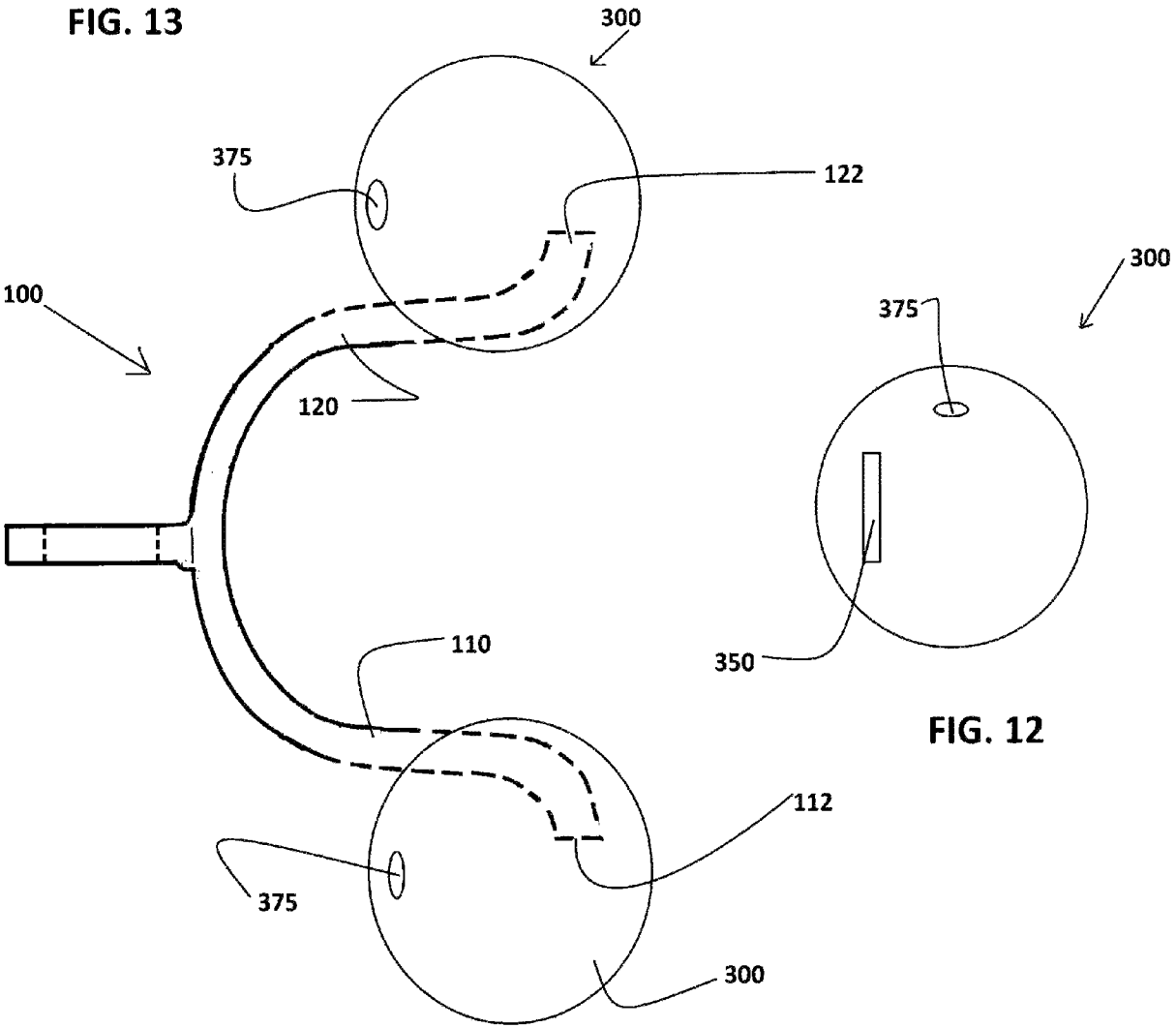
FIG. 12 shows another embodiment of using a ball with a slit in the side.
FIG. 13 shows the ball mounted to the latch where caulking material, such as but not limited to silicon is injected into the ball to fixably adhere the ball to the latch.
Figure 16:
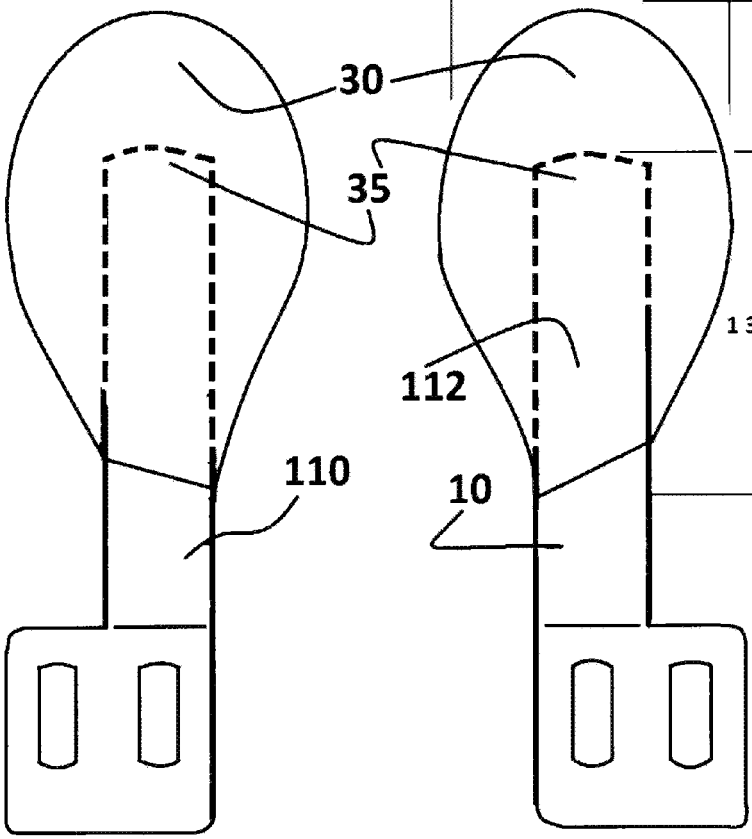
FIG. 16 is a right side view of the cover attached to the gate latch shown in FIG. 5.
Figure 17:
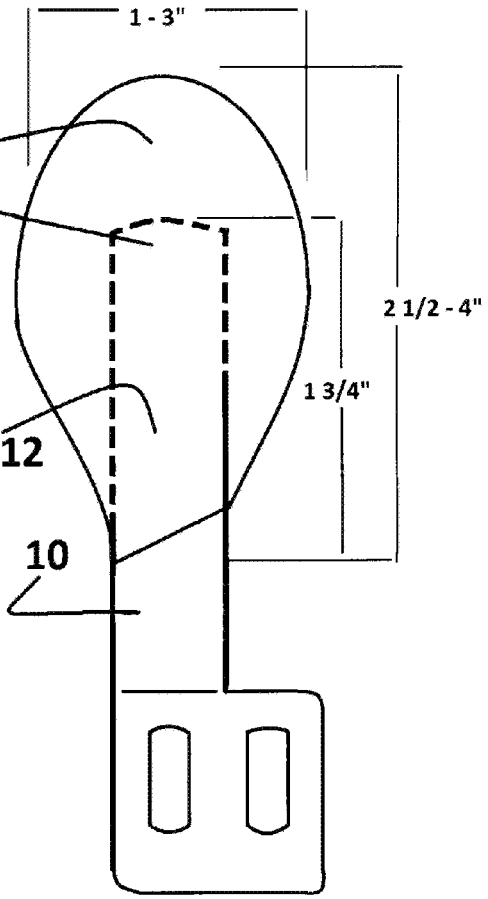
FIG. 17 is a left side view of the cover attached to the gate latch shown in FIG. 5.

FIG. 12 shows another embodiment of using a ball 300 with a slit 350 in the side. FIG. 13 shows the ball mounted to the latch where caulking material, such as but not limited to silicon is injected into the ball to fixably adhere the ball to the latch. The ball can include but not be limited to a ball having a spherical rubber type elastomer about a hollow core with an outer cloth type layer, such as a tennis ball. A typical sized tennis ball having a diameter of approximately 2.63 inches can be used.

Referring to FIGS. 12-13, a slit 350 can be cut into the side of the ball 300, and the ball placed over the tip edge of each arm flange of the gate latches 100. Next, a caulking material, such as silicon, and the like, can be injected into the slit 350 or into another opening 375, around the tip of the flange arms of the gate latches, which will fixably adhere the balls about the outer flange arm tip edges, as a safety protection.

Although tennis balls have been described, other types of hollow elastomeric spherical balls can be used, such as but not limited to a racquetball having a diameter of approximately 2.25 inches, a paddleball, other small bouncing balls, and the like. Additionally, solid balls, can be used, such as but not limited to golf balls, and the like.

The surface of the balls, bulbous portions and dome portions can have advertising indicia thereon, such as but not limited to company names, sports team names, design logos, and the like.

The pivotable oar, fork and U-shaped latches 100 shown and described in relation to the figures can pivot up or down in a vertical plane or pivot sideways in a horizontal plane to be used with existing oar, fork or U-shaped gate latches.

Although non-metal materials are described for the covers, the covers and replacement gate latches can be made from metal materials, such as but not limited to aluminum, galvanized metal, and the like, with or without non-metal materials, such as those described above.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. Sleeve covers with ball shapes for protecting ends of existing arms of a pivotable U-shaped gate latch, comprising:

a first sleeve having a closed end and an open end with a slit, the closed end having a rounded blunt exterior surface with a generally ball shape and a diameter substantially larger in diameter than a diameter of the open end of the sleeve, the generally ball shape having another opening smaller than the slit;

a second sleeve having a closed end and an open end with a slit, the closed end having a rounded blunt exterior surface with a generally ball shape and a diameter substantially larger in diameter than a diameter of the open end of the sleeve, the generally ball shape having another opening smaller than the slit, wherein the first sleeve and the second sleeve are adapted to slide on and cover the exposed existing tip ends of existing arms on a pivotable U-shaped gate latch; and a caulking or bonding or adhering or filling material to be injected into each smaller opening of the ball shape of the first sleeve and the ball shape of the second sleeve, for fixably attaching each sleeve to the existing arms of the pivotable U-shaped gate latch.

2. The sleeve covers of claim 1, wherein the diameter of the closed end is at least twice the diameter of the exposed tip ends of the arms on the pivotable U-shaped gate latch.

3. The sleeve covers of the claim 1, wherein the first and the second sleeve covers are formed from a rubber material.

4. The sleeve covers of the claim 1, wherein the first and the second sleeve covers are formed from a plastic material.

5. The ball shaped covers of claim 1, wherein the first and the second balls include: tennis balls.

6. The ball shaped covers of claim 1, wherein the first and the second balls include: paddle balls.

7. The ball shaped covers of claim 1, wherein the first and the second balls include: golf balls.

8. Ball shaped covers for protecting exposed parts of a pivotable U-shaped gate latch, comprising:

a first ball with a rubber spherical outer core, the first ball having a slit opening along one side portion, and another opening smaller than the slit;

a second ball with a rubber spherical outer core, the second ball having a slit opening along one side portion, and another opening smaller than the slit; and a caulking or bonding or adhering or filling material to be injected into each smaller opening of the first ball and the second ball, wherein the slits of the first and second balls are adapted to slide over exposed tip ends of existing arms on a pivotable U-shaped gate latch so that the balls provide protection to the exposed tip ends of the existing arms on the pivotable U-shaped gate latch.

9. The ball shaped covers of claim 8, wherein the first and the second balls are tennis balls.

10. The ball shaped covers of claim 8, wherein the caulking material is silicon.

11. Ball shaped covers for protecting arms of a pivotable U-shaped gate latch, comprising:

a first ball with a ball shaped outer core, the first ball having a slit opening along one side portion, and another opening smaller than the slit;

a second ball with a ball shaped outer core, the second ball having a slit opening along one side portion, and another opening smaller than the slit; and a caulking or bonding or adhering or filling material to be inserted into each smaller opening of the first ball and the second ball, wherein the slits of the first and second balls are adapted to slide over exposed tip ends of existing arms on a pivotable U-shaped gate latch so that the balls provide protection to the arms on the pivotable U-shaped gate latch.

* * * * *